US006106256A

United States Patent [19]

Talaski

[11] Patent Number: 6,106,256

[45] Date of Patent: Aug. 22, 2000

[54] GEAR ROTOR FUEL PUMP

[75] Inventor: Edward J. Talaski, Caro, Mich.

[73] Assignee: Walbro Corporation, Cass City, Mich.

[21] Appl. No.: 09/062,792

[22] Filed: Apr. 20, 1998

[51] Int. Cl.[7] ..... F01C 1/10

[52] U.S. Cl. ..... 418/171; 418/166

[58] Field of Search ..... 418/171, 166

[56] References Cited

U.S. PATENT DOCUMENTS

| | | | |
|---|---|---|---|
| 4,235,217 | 11/1980 | Cox | 418/171 X |
| 5,219,277 | 6/1993 | Tuckey | 417/366 |
| 5,582,514 | 12/1996 | Arbogast et al. | 418/171 X |
| 5,628,626 | 5/1997 | Hansen | 418/171 X |

*Primary Examiner*—Hoang Nguyen
*Attorney, Agent, or Firm*—Reising, Ethington, Barnes, Kisselle, Learman & McCulloch, P.C.

[57] ABSTRACT

An electric motor fuel pump has an inner gear rotor and an outer gear rotor each with a plurality of radially opposed intermeshing teeth each having a pair of driving surfaces and defining circumferentially disposed expanding and ensmalling pumping chambers through which fuel is drawn and then discharged under pressure. The inner gear rotor is coupled to a motor armature journalled for rotation within a fuel pump housing to drive the inner gear rotor and the associated outer gear rotor. The teeth of each gear rotor have a step formed thereon providing a pair of offset driving surfaces on at least each driving face of each tooth and preferably offset trailing surfaces on each trailing face of each tooth. The stepped tooth profile permits greater eccentricity between inner and outer gear rotors which increases the fuel displacement of the gear rotors. The stepped tooth profile also provides more teeth for a given pitch diameter and increased design freedom which facilitates optimization of the drive angle between mated gear rotors.

17 Claims, 2 Drawing Sheets

GEAR ROTOR FUEL PUMP

FIELD OF THE INVENTION

This invention relates to fuel pumps and more particularly to a gear rotor type positive displacement fuel pump.

BACKGROUND OF THE INVENTION

U.S. Pat. No. 5,219,277 discloses an electric motor gear rotor type fuel pump having intermeshing inner and outer gear rotors positioned within a housing of the fuel pump in cooperation with inlet and outlet ports of the housing for pumping fuel from a vehicle tank and delivering the fuel under pressure to a vehicle engine. The inner and outer gear rotors have a plurality of teeth which intermesh when driven by the electric motor of the fuel pump and define circumferentially disposed enlarging and ensmalling pumping chambers through which the liquid fuel is drawn and discharged under pressure. The teeth of each gear rotor have uniform and continuous faces forming smooth driving surfaces when intermeshed.

The design of these gears is limited by many physical factors including the number of teeth, amount of eccentricity between inner and outer gears, displacement, location of the fuel ports for the gears, and the necessary size of the teeth to withstand the forces applied to them in use. While these parameters may be independently varied, the overall shape of the tooth is generally constant and greatly limits the ability to optimize the gears as to drive angles and other parameters which effect the performance and durability of the gears.

SUMMARY OF THE INVENTION

An electric motor gear rotor type fuel pump has an inner gear rotor and an outer gear rotor each with a plurality of radially opposed intermeshing teeth each having a pair of driving surfaces and defining circumferentially disposed enlarging and ensmalling pumping chambers into which fuel is drawn and then discharged under pressure. The inner gear rotor is coupled to an electric motor armature journalled for rotation within a fuel pump housing to drive the inner gear rotor and the associated outer gear ring. The teeth of the gear rotor and ring have a step formed thereon providing a discontinuous face and a pair of driving surfaces at least on each driving face of each tooth and preferably on both faces of each tooth.

This gear tooth configuration provides increased design freedom as the overall shape of the tooth is not critical and can be readily varied in design. This design freedom enables increased eccentricity between the inner and outer gear rotors which increases the maximum pumping chamber volume and hence the amount of fuel displaced by the gear rotors. Further, because of the design freedom, the drive angle between the gears can be optimized to reduce forces acting radially with respect to the pitch circles of the gears and thereby increase the forces acting tangentially to the pitch circles. Also, the variation of the drive angle throughout the rotation of the gears can be minimized to provide more consistent forces on the gears.

BRIEF DESCRIPTION OF THE DRAWINGS

Objects, features and advantages of this invention will be apparent from the following detailed description of the preferred embodiment and best mode, appended claims and accompanying drawings in which:

DETAILED DESCRIPTION OF THE PREFERRED EMBODIMENT

Figure 1:
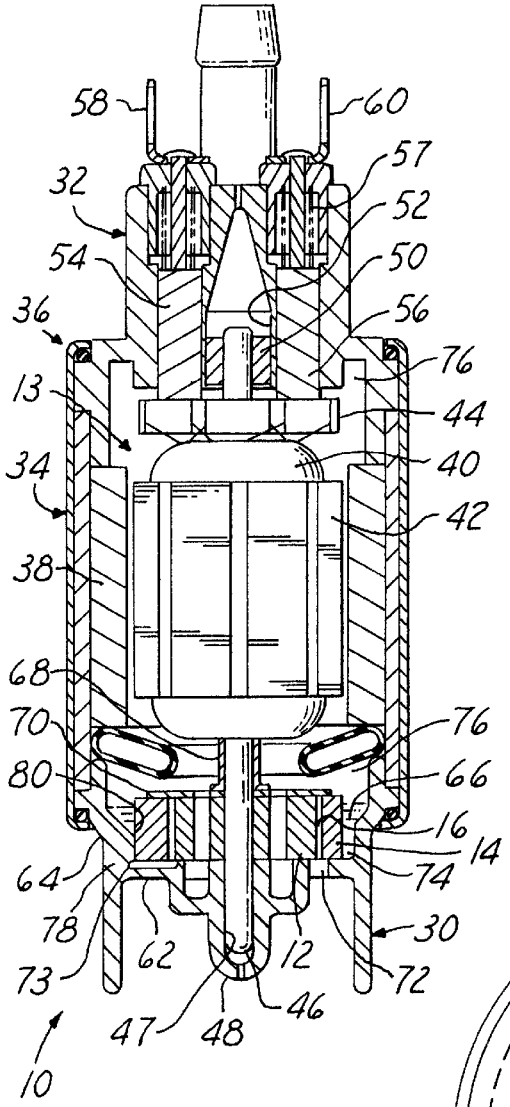
FIG. 1 is a sectional view of a fuel pump embodying this invention.

Referring in more detail to the drawings, FIG. 1 shows an electric motor gear rotor type fuel pump 10 having an inner gear rotor 12 driven to rotate by the electric motor 13 of the fuel pump 10 to drive an outer gear rotor 14 and deliver fuel through enlarging and ensmalling chambers 16, 17, respectively, defined between the teeth 18, 19 of the inner 12 and outer 14 gear rotors. Each tooth 18, 19 has a stepped configuration providing a pair of driving surfaces 20, 22 at least on one face 24 of each tooth 18, 19 and preferably on each face 24 of each tooth 18, 19. The fuel pump 10 has an inlet end cap 30 and an outlet end cap 32 axially spaced from each other and coaxially received in a shell 34 to form a unitary hollow pump housing assembly 36. A permanent magnet stator 38 is carried within the shell 34 surrounding an armature 40 which has electrical windings 42 connected to a commutator plate 44. The armature 40 is journalled between the inlet 30 and outlet 32 end caps by a shaft 46 for rotation within the housing 36. Specifically, the shaft 46 is rotatably received within a blind bore 47 in a boss 48 centered in the inlet end cap 30. A sleeve bearing 50 is press-fitted or otherwise secured to the opposing end of the shaft 46 and is both rotatably and axially slibably received in a bore 52 centered in the outlet end cap 32. A pair of brushes 54, 56 are carried by the outlet end cap 32 and urged by spring 57 into sliding engagement with the commutator plate 44 and are electrically connected by flexible wires to a pair of terminals 58, 60 on the outlet end cap 32 for applying electrical power to the commutator plate 44 and armature 40.

The inlet end cap 30 is generally cup shaped and has a radial wall or base 62 with the boss 48 centered therein and a flange 64 to which the shell 34 is externally affixed. The base 62 and flange 64 form a pocket or counterbore 66 axially aligned with and opposed to the armature 40. The inner and outer gear rotors 12, 14 are positioned within this end cap pocket 66 with the inner gear rotor 12 press-fitted or otherwise rotatably coupled to the shaft 46 spaced from the armature 40 by a collar 68 and a rotary seal 70. The seal 70 is preferably free to rotate with the outer gear rotor 48 to reduce friction between them. A fuel inlet port 72 extends through the base 62 to admit fuel at inlet pressure to the expanding chambers 16 defined between the inner and outer gear rotors 12, 14. A recess or groove 73 (shown out of position) is disposed in the base 62 to form an outlet port discharging fuel under pressure from the ensmalling chambers between the inner and outer rotors. The recess 73 extends radially outwardly from the ensmalling pumping chambers 16 beyond the periphery of the outer gear rotor 14. The outer gear rotor 14 is spaced and separated from the ring 64 by a radial gap 74 that substantially surrounds the entire outer gear rotor 14. The recess 73 opens radially outwardly into this gap 74 and thus, fluid at outlet pressure is fed from the pocket through the gap 74 to the open cavity 76 within the pump housing 36.

A bearing pad 78 is integral with the ring 64 and extends radially inwardly therefrom to provide an arcuate bearing surface 80 of limited circumferential extent and in sliding contact with the periphery of the outer gear rotor 14. The bearing surface 80 has the same radius of curvature as the outer periphery of the outer gear rotor 14. Fluid pressure holds the outer gear rotor 14 against the bearing surface 80 of the pad 78 while the remainder of the outer gear rotor 14 periphery is spaced by the gap 74 from the surrounding ring 44. The construction and operation of the pump 10 is substantially the same as the pump described in U.S. Pat. No. 5,219,277, the disclosure of which is incorporated herein by reference in its entirety, with the exception that the pump 10 has gear rotors with teeth having a different configuration than those of U.S. Pat. No. 5,219,277.

Figure 2:
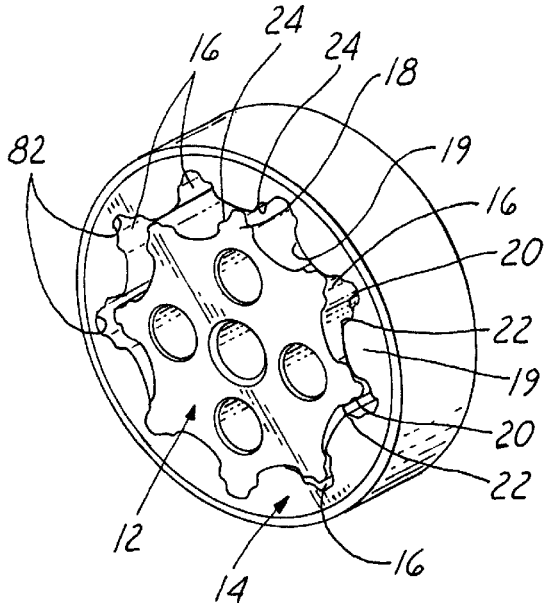
FIG. 2 is a perspective view of an inner gear rotor received within an outer gear rotor of the pump of FIG. 1.
Figure 3:
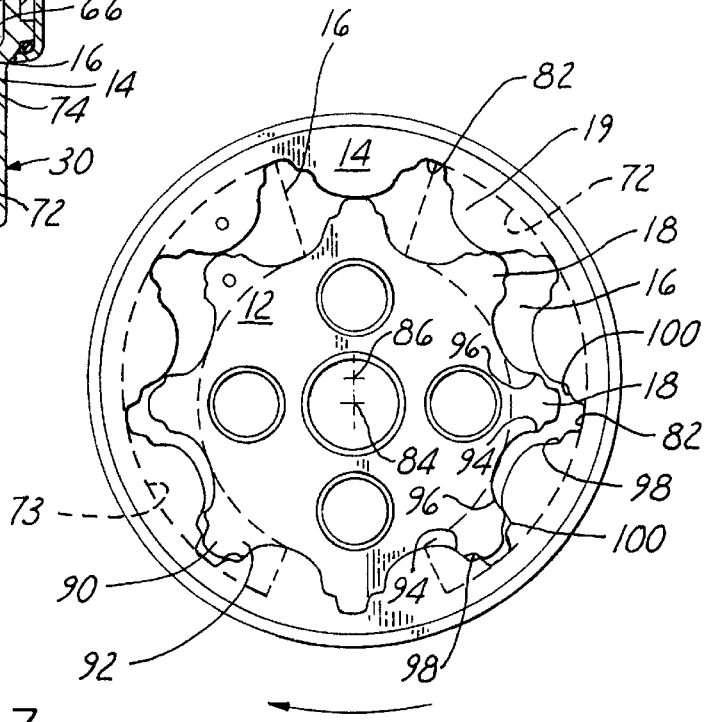
FIG. 3 is an end view of the gear rotors of FIG. 2.
Figure 4:
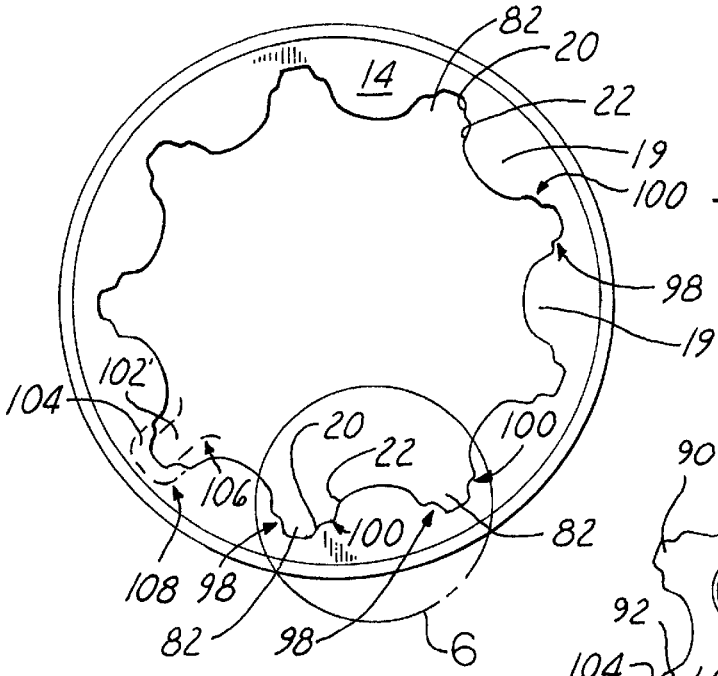
FIG. 4 is an end view of the outer gear rotor.
Figure 5:
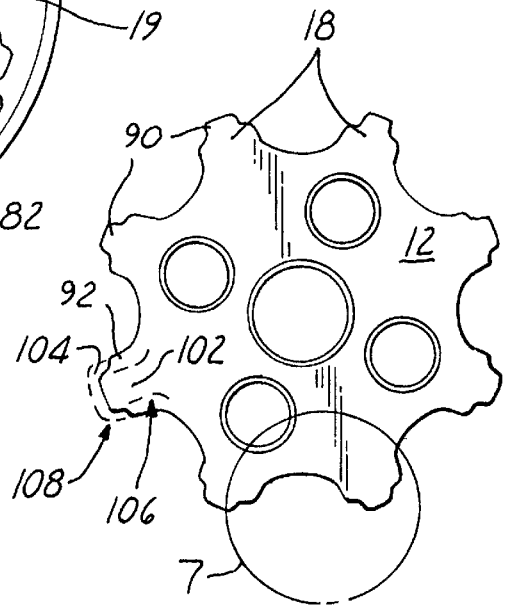
FIG. 5 is an end view of the inner gear rotor.
Figure 6:
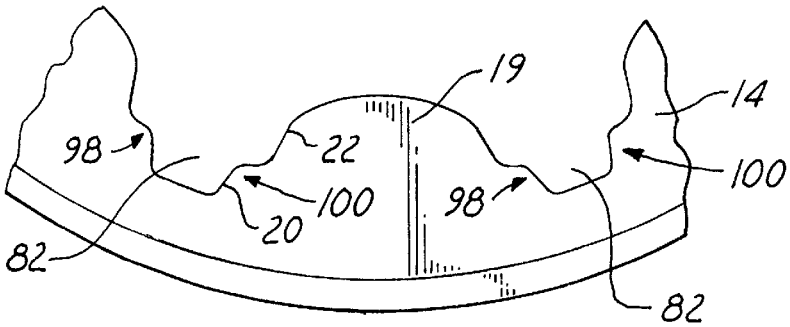
FIG. 6 is an enlarged view of the encircled portion of FIG. 4.
Figure 7:
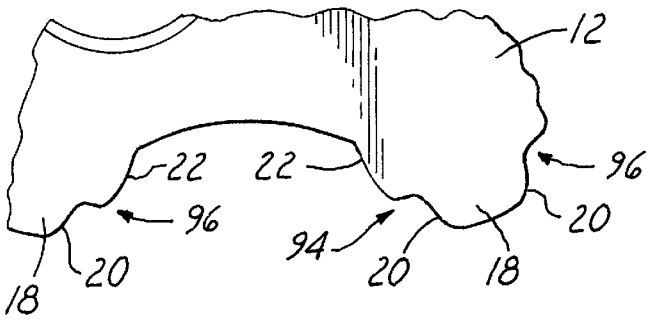
FIG. 7 is an enlarged view of the encircled portion of FIG. 5.

As shown in FIG. 2, the inner gear rotor 12 has a plurality of radially outwardly extending teeth 18 and is received interiorly of an outer gear ring or rotor 14 which has a plurality of recesses 82 complementarily shaped to closely receive a tooth 18 of the inner gear rotor 12 and defined by a plurality of radially inwardly extending gear teeth 19 of the outer gear rotor 14. As shown in FIG. 3, the outer gear rotor 14 is eccentrically disposed relative to the inner gear rotor 12 and rotates about an axis 86 parallel to and radially offset from the axis of rotation 84 of the inner gear rotor 12 which is also coincident with the axis of rotation of the motor armature 40. As shown, the inner gear rotor 12 has eight teeth 18 and the outer gear rotor 14 has nine teeth 19 with nine recesses 82 defined therebetween. The eccentric mounting of the outer gear rotor 14 relative to the inner gear rotor 12 and the greater number of teeth 19 and recesses 82 on the outer gear rotor 14, provide the enlarging and ensmalling pumping chambers 16, 17 through which fuel is drawn and discharged under pressure.

A stepped profile provides distinct base 90 and tip 90 portions preferably on both the driving face 94 and the trailing face 96 of the inner gear rotor teeth 18 and the receiving face 98 and the trailing face 100 of the outer gear rotor recesses 82. When a tooth 18 of the inner gear rotor 12 initially engages a recess 82 of the outer gear rotor 14, the driving face 94 of the inner gear rotor 12 contacts the receiving face 98 of the outer gear rotor 14 thereby driving the outer gear rotor 14 for co-rotation with the inner gear rotor 12. Upon further rotation, the trailing face 96 of the inner gear rotor tooth 18 is rolled into engagement with the trailing face 100 of the outer gear rotor recess 82. Upon still further rotation, the next succeeding inner gear rotor tooth 18 is engaged with the next outer gear rotor recess 82 in the same manner. Movement of a tooth 18 away from an associated recess 82 increases or expands the volume of the pumping chamber 16 defined therebetween and into which fuel is drawn. Movement of a tooth 18 towards an associated recess 82 decreases the volume of the associated pumping chamber 17 and displaces the fuel therein. In this manner, fuel is drawn into the gear enlarging chambers 16 defined by the rotors 12, 14 and discharged from the ensmalling chambers 17, under pressure, to be delivered to the vehicle engine. As best shown in FIG. 3, the tooth 18 to tooth 19 contact between the inlet port 72 and outlet recess 73 provides a seal to prevent direct communication between the inlet 72 and outlet 73.

The stepped tooth profile of the inner gear rotor 12 and outer gear rotor 14 is preferably constructed by defining first and second gear rotor sets 102, 104 each having the same number of teeth and each with substantially continuous driving surfaces 106, 108. The first set 102 has a narrower tooth profile than the second set 104 and is overlaid on the second set 104 providing a reduced width tip 90 of the tooth as shown in FIGS. 4–7. Thus, each tooth 18, 19 has a base 92 defined by the second set 104 and a tip 90 defined by the first set 102 defining a stepped tooth profile with a pair of driving surfaces 20, 22 on each tooth 18, 19. The continuous driving surfaces 106, 108 (and hence the driving surfaces 20, 22 on each tooth) may be inclined at different angles so that during driving contact the deviation of the force, from a tangent to the pitch circles of the mated gears, is reduced. The teeth 18, 19 are preferably designed so that at some angular displacement between mated teeth there is a transition from one driving surface 22 to the other 20. The driving surfaces are sufficiently circumferentially offset to provide clearance and avoid interference between the teeth as they engage and disengage. The overall shape of the tooth profile is not critical and can be freely altered to reduce wear on the teeth and to increase fuel displacement through the gear rotors 12, 14. Further, many of the limitations of designing prior tooth profiles are eliminated and the stepped tooth profile can be readily altered in design to minimize variances in the drive angles between the gear rotors 12, 14 throughout their rotation. The ability to design for an optimum drive angle which can be maintained throughout the rotation of the gears increases the efficiency of the gear rotors 12, 14 by reducing the magnitude of the radially acting force applied between the gear teeth thereby applying the force more directly along or tangent to the pitch circles of the mating gear rotors 12, 14.

The stepped configuration of the inner gear rotor and outer gear rotor teeth 18, 19 provide increased flexibility of design as compared to prior gear teeth configurations which permits the drive angle to be more readily and easily optimized to reduce the forces acting on the gear rotors 12, 14 radially or non-tangentially with respect to their pitch circles and thereby maximize the force applied tangentially with the pitch circles of the mated gears. In addition, the stepped tooth design permits a greater offset or eccentricity between the gear rotors 12, 14 which leads to an increased maximum pumping chamber volume 16 and hence, a greater displacement of fuel through the gear rotors 12, 14. It is also currently believed that because the drive angle can be optimized to reduce the radial forces on the gears, there is less slippage or relative tooth motion between adjacent and mating teeth and thus, possible reduced friction and wear on the teeth and reduced noise of the fuel pump 10 in use. Further, the stepped tooth profile permits the use of more teeth for a given pitch diameter which thereby increases the displacement per revolution of the rotors and reduces the variation in output fuel pressure and the noise produced by variations and pulsations of the output fuel pressure.

What is claimed:

1. A fuel pump comprising:

a power unit to drive the fuel pump;

a housing substantially enclosing the fuel pump;

an inlet in the housing through which fuel is drawn into the fuel pump;

an outlet in the housing through which fuel is delivered from the fuel pump under pressure;

an inner gear rotor driven to rotate by the power unit and having a plurality of gear teeth each having on one face at least two driving surfaces which are circumferentially and radially offset;

an outer gear rotor eccentrically surrounding the inner gear rotor and having more recesses than the number of gear teeth of the inner gear rotor, each recess complementarily shaped and constructed to receive a gear tooth of the inner gear rotor to mate therewith and having on one face at least two receiving surfaces which are circumferentially and radially offset, complimentary with and engageable by the at least two driving surfaces;

the driving and receiving surfaces of the gear teeth being constructed and arranged so that during each revolution of the inner gear rotor all the driving surfaces of each gear tooth thereof engage the corresponding receiving surfaces of and drive the outer gear rotor and at some angular displacement of each gear tooth of the inner gear rotor there is a transition of the driving force from one driving surface to another driving surface on the one face thereof; and a plurality of pumping chambers defined between the inner gear rotor and the outer gear rotor whereby rotation of the inner gear rotor successively engages each inner gear tooth within each recess of the outer gear rotor thereby ensmalling a pumping chamber and displacing any fuel therein while simultaneously enlarging a pumping chamber at another location into which additional fuel is drawn.

2. The fuel pump of claim 1 wherein each gear tooth of the inner gear rotor has a step formed in at least one face therein providing a pair of driving surfaces.

3. The fuel pump of claim 1 wherein each gear tooth of the inner gear rotor has a step formed in each face of the gear tooth.

4. The fuel pump of claim 1 wherein each gear tooth has a generally continuous, concave and arcuate face and a discontinuous second face providing at least two driving surfaces.

5. The fuel pump of claim 2 wherein the step has generally arcuate edges.

6. The fuel pump of claim 1 wherein the outer gear rotor has one more recess than the number of teeth on the inner gear rotor.

7. The fuel pump of claim 6 wherein the outer gear rotor has nine recesses and the inner gear has eight teeth.

8. The fuel pump of claim 6 wherein the outer gear rotor has at least one more recess than the inner gear rotor has teeth.

9. A method of making a fuel pump comprising the steps of:

a.) providing a power unit with a rotational output;

b.) providing an inner gear rotor driven to rotate by the power unit and having a plurality of gear teeth each having on one face at least two circumferentially and radially offset driving surfaces;

c.) providing an outer gear rotor eccentrically surrounding the inner gear rotor, having at least one more recess than the number of teeth of the inner gear rotor, each recess being complementarily shaped to and constructed to receive a gear tooth of the inner gear rotor to rotate therewith and define between the inner and outer gear rotors circumferentially disposed enlarging and ensmalling pumping chambers and having on one face at least two receiving surfaces which are circumferentially and radially offset, complimentary with and engageable by the at least two driving surfaces on one face of the gear tooth of the gear rotor; and d.) the driving and receiving surfaces of the gear teeth being constructed and arranged so that during each revolution of the inner gear rotor all the driving surfaces on one face of each gear tooth thereof engage the corresponding receiving surfaces on one face of one gear tooth of and drive the outer gear rotor and at some angular displacement of each gear tooth of the inner gear rotor there is a transition of the driving force from one driving surface to another driving surface on one face thereof.

10. The method of claim 9 wherein each tooth of the inner gear rotor has two different tooth profile portions with said tooth profile portions providing a discontinuous tooth profile having two circumferentially offset driving surfaces.

11. The method of claim 10 wherein the two different tooth profile portions are combined to provide a substantially continuous overall tooth profile with generally similar driving and trailing faces.

12. The method of claim 11 wherein each tooth of the inner gear rotor has a narrower tooth profile portion defining a tip of the tooth and a wider tooth profile portion defining a base portion of the tooth.

13. The method of claim 9 wherein the outer gear rotor has one more recess than the number of teeth on the inner gear rotor.

14. The method of claim 13 wherein the outer gear rotor has nine recesses and the inner gear rotor has eight teeth.

15. The method of claim 9 wherein the outer gear rotor has at least one more recess than the inner gear rotor has teeth.

16. The fuel pump of claim 1 wherein each gear tooth of the inner gear rotor has a step formed in at least one face thereof providing a first driving surface adjacent the base and a second driving surface adjacent the tip of each gear tooth and first and second driving surfaces are constructed so that the transition of the driving force is from the first driving surface to the second driving surface on the one face of each gear tooth.

17. The method of claim 9 wherein each gear tooth of the inner gear rotor has a step formed in at least one face thereof providing a first driving surface adjacent the base and a second driving surface adjacent the tip of each gear tooth and first and second driving surfaces are constructed so that the transition of the driving force is from the first driving surface to the second driving surface on the one face of each gear tooth.

* * * * *